United States Patent [19]

Inowa et al.

[11] 4,123,156

[45] Oct. 31, 1978

[54] METHOD AND APPARATUS FOR FORMING AN ELECTROSTATIC LATENT IMAGE USING AN IRON CONTROL GRID WITH DUAL ELECTRICAL FIELDS

[75] Inventors: Shigeru Inowa; Issei Nakamura; Tutomu Furuya, all of Hachioji, Japan

[73] Assignee: Konishiroku Photo Industry Co., Ltd., Hachioji, Japan

[21] Appl. No.: 788,831

[22] Filed: Apr. 19, 1977

[30] Foreign Application Priority Data

Apr. 26, 1976 [JP] Japan ..... 51-47410

[51] Int. Cl.[2] ..... G03G 15/00

[52] U.S. Cl. ..... 355/3 SC; 96/1 R; 355/3 CH

[58] Field of Search ..... 355/3 SC, 3 CH, 3 R; 96/1 R, 1 C

[56] References Cited

U.S. PATENT DOCUMENTS

| | | | |
|---|---|---|---|
| 3,867,673 | 2/1975 | Crane et al. | 355/3 SC |
| 3,880,513 | 4/1975 | Fotland | 355/3 SC |

*Primary Examiner*—R. L. Moses

*Attorney, Agent, or Firm*—Lane, Aitken, Dunner & Ziems

[57] ABSTRACT

Improved method and apparatus for forming an electrostatic latent image on a recording medium by the simultaneous projection of an ion current and exposure to image light, in which a control grid for controlling the ion current has a plurality of layers, including a photoconductive layer, a conductive layer, and an insulating layer. A first bias voltage is applied to the conductive layer to form an electric field which directs the ion current toward the recording medium, and a second bias voltage, higher than the first bias voltage, forms a second electric field in the control grid for controlling passage of the ions. The recording medium is adapted to absorb the image light thereon.

12 Claims, 6 Drawing Figures

METHOD AND APPARATUS FOR FORMING AN ELECTROSTATIC LATENT IMAGE USING AN IRON CONTROL GRID WITH DUAL ELECTRICAL FIELDS

BACKGROUND OF THE INVENTION

1. Field of the Invention

The present invention relates to a method and an apparatus for forming an electrostatic latent image on a recording medium by controlling an ionic current in accordance having imagewise exposure through the use of a control grid with a photoconductive layer, and more particularly, to an improved method and apparatus in which an electrostatic latent image is formed on the recording medium by simultaneous charging the medium with an ion current and exposing it to image light.

2. Description of the Prior Art

Among the conventional arts employing a control grid, there are known some methods as disclosed in the U.S. Pat. Nos. 3,645,614 and 3,713,734. According to such prior arts using a control grid A of a four-layer structure, the steps of charging, exposure and ion projection are conducted sequentially, as illustrated in FIG. 1A, 1B and 1C, to form an electrostatic latent image on a recording medium composed of a nonconductive layer and a conductive member superposed thereon, and subsequently a suitable means such as developing device is used to deposit a toner on the latent image to produce a visible image. Since this method effects accurate control of an ionic current in accordance with an optical image, it is possible to obtain a clear image of satisfactory quality with excellent gradation reproducibility.

However, the above methods have disadvantages. Since it is necessary to conduct exposure on the side of the photoconductive layer of a control grid A, as illustrated in FIG. 1A and, after termination of the exposure, to project ion through the control grid A toward the recording medium by a corona charger C or the like, as shown in FIG. 1C, an image projection system must be replaced by the recording medium with respect to the control grid in the ion projection system. Such replacement is particularly disadvantageous in designing a copying machine. Moreover, the above-mentioned sequential process required relatively long time for copy cycle and therefore, is disadvantageous for copy process with high speed. Furthermore, the aforementioned method requires a charger for charging a photoconductive layer and another charger for projecting ions, or requires a means to change, at the time of charging and ion projection, a bias potential applied to the bias layer of a control grid.

For example, in the method disclosed in the Japanese Patent Gazette 45-30320, a plurality of grids are employed to control ions by an electric field between the grids, or by an electric field between the grids and a recording medium, in such a manner that the ions passing through the grids are accumulated on the recording medium under control. For producing a clear image by this method, it is necessary to maintain a considerably higher accuracy with respect to the distance between the grids and also the distance between the grids and the recording medium, or a complicated grid structure is required.

In the method disclosed in the U.S. Pat. No. 3,220,324, charging is performed simultaneously with imagewise exposure by the use of a grid having a photoconductive layer on a conductive screen, so as to control the accumulation of ions on a recording medium. However, it is hard in this case to attain strict control of ions in accordance with an optical image, and an increase of the image contrast is difficult. Moreover, in the methods of the foregoing two patents, the reproduced images are poor in gradation. The present invention provides an improved method which solves all of such problems and can be implemented with facility to constitute a practical apparatus of a relatively simple structure.

SUMMARY OF THE INVENTION

The principal object of the present invention is to produce quickly a clear electrostatic latent image faithful to an original image by the operation of an extremely simplified apparatus.

Another object is to make it possible to use merely a single power source for applying a high voltage to a charger instead of two power sources needed heretofore in the prior arts.

Another important object resides in providing a means to solve the problems in the known arts of producing an electrostatic latent image by the use of a control grid.

According to the present invention, the above-mentioned objects are performed by an apparatus for forming an electrostatic image on a recording medium, in which a control grid is used for controlling ion current, comprising: a control grid which includes a photoconductive layer, a conductive layer and an insulating layer, which are superposed in this order; means for forming a first electric field between said control grid and said recording medium to direct ions toward said recording medium, said means being connected to said conductive layer; means for forming a second electric field in the apertures of said control grid to prevent ion from passing through said apertures; an electrically discharging means for projecting ions on the surface of said photoconductive layer; an optical image projection means for forming an optical image on said surface of said photoconductive layer; and said electrically discharging means and said optical image projection means being arranged so that the area of said control grid which is being exposed to the ion current from said electrically discharging means is exposed to the light from said optical image projection means.

According to the present invention, the first electric field and the second electric field are formed respectively, by applying a first bias voltage to the conductive layer to form the electric field which directs the ion current having passed through the apertures of the control grid toward the recording medium and by providing a second bias voltage higher than the first bias voltage on the insulating layer.

In the foregoing discussion, the relationship between the first bias voltage and the second bias voltage has the following context. The polarity of the bias voltages is selected in accordance with the property of the photoconductive layer. For example bias voltages of positive polarity are applied in case of a selenium photoconductor and bias voltages of negative polarity are applied in case of zinc oxide photoconductor. Accordingly, when the second bias voltage is stated to be higher than the first voltage, the second voltage is larger than the first voltage in absolute value. Therefore, an apparatus in which the first and second voltages of negative polarity are respectively applied to the conductive layer and the insulating layer, and the absolute value of the second voltage is larger than that of the first voltage, fall within the scope of the present invention.

DETAILED DESCRIPTION OF THE PREFERRED EMBODIMENTS

Figure 1A:
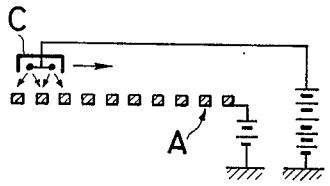
FIG. 1A PRIOR ART
FIGS. 1A–1C are diagramatic views of a conventional apparatus which shows the process of forming a latent image.
Figure 1B:
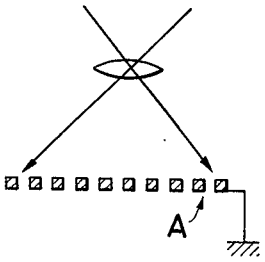
FIG. 1B PRIOR ART
Figure 1C:
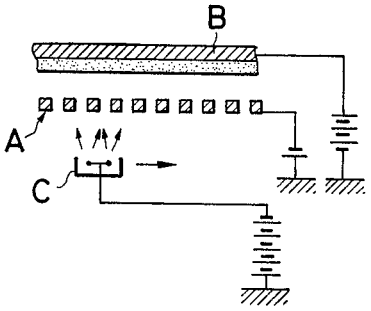
FIG. 1C PRIOR ART
Figure 2:
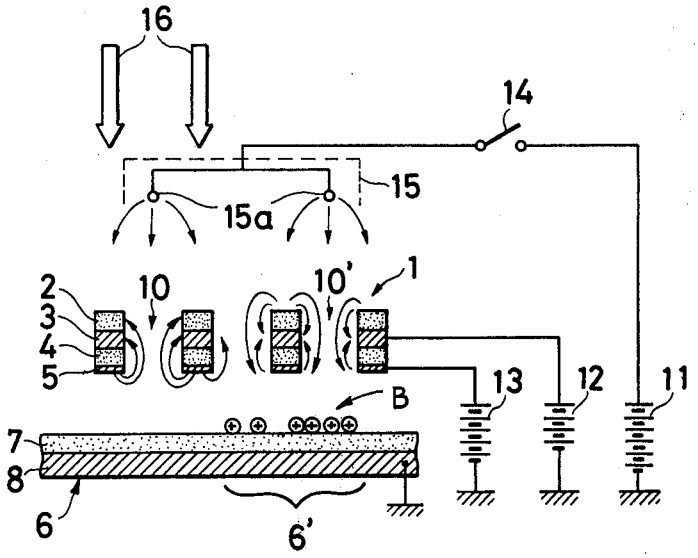
FIG. 2 is a diagram which shows the principle of the process of forming a latent image according to the present invention.
Figure 3:
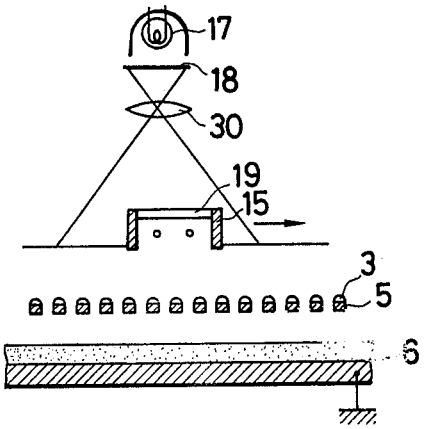
FIG. 3 is an elevational view showing one embodiment according to the present invention.

Hereinafter the process for this invention to form an electrostatic latent image corresponding to an original image will be described with reference to FIG. 2 showing the principle of operation of the invention. In the cross-sectional view of a control grid 1, a photoconductive layer 2 is formed on a conductive base screen 3 having a large plurality of apertures, while a nonconductive layer 4 and a conductive layer 5 are formed on the reverse side of the photoconductive layer 2 in this order. A recording medium 6 is disposed substantially in parallel with the control grid 1 at a suitable interval ranging from 1 to 10 mm. The recording medium is composed of a conductive base layer 8 and a nonconductive layer 7 formed thereon. On the side of the control grid 1 opposite from the recording medium 6 is a corona discharger 15 for discharging corona current, and an original image projector (not shown) for projecting the optical image of an original to effect exposure is located above the charger 15, wherein a portion being exposed to the image projector light is indicated by thick arrows 16. The corona discharger 15 is preferably of a type in which the exposing light passes through the corona discharger as shown in FIG. 3. Wires 15*a* of the charger 15 are connected to a high-voltage power source 11 through a switch 14, and a potential of +500 V to +4 KV is applied from a power source 12 to the conductive layer 3. This potential is adjusted in relation to the distance between the control grid 1 and the recording medium 6 so that an electric field in a range preferably from 200 to 800 V/mm is provided in this space between the control grid 1 and the recording medium 6. A power source 13 is connected to the conductive layer 5 in such a manner that a potential, which is higher than the conductive layer 3 by 50 V to 300 V preferably, is applied thereto.

In such a state, apertures 10, 10' of the control grid 1 generate an electric field as shown by the arrows directed upward from the conductive layer 5. When a switch 14 is closed to cause a corona discharge while exposing the photoconductive layer 2 of control grid 1 to an imagewise light, the photoconductive layer 2 is rendered conductive in its portion exposed to the light, so that ions from the corona discharger 15 flows to the conductive layer 3 by way of the photoconductive layer 2. The ions directed toward the opening 10 are prevented from passing there by the electric field directed upward from the conductive layer 5, so that the ions flow to the conductive layer 3 without reaching the recording medium 6. In the unirradiated portion or the right half in FIG. 2, static charges are accumulated on the photoconductive layer 2 due to the ions projected by the corona discharge, and its surface is charged at a potential higher than the conductive layer 3 by several 10 to several hundred volts. In the aperture 10' of this portion, an electric field is generated, which is directed downward from the photoconductive layer surface and has a greater intensity than the field directed upward from the conductive layer 5. Thus, the ions projected downward from the corona charger 15 are accelerated in the aperture 10' by the above electric field and, after passing through the aperture 10', the ions are brought to the recording medium 6 by the electric field applied between the control grid 1 and the recording medium 6, hence forming a charge image B thereon.

The above description relates to the extreme cases concerning the two irradiated and unirradiated portions. As for the portion exposed to feeble light, ions pass through only the part proximate to the center of the opening so that static charges are accumulated in a small dot-like area on the recording medium 6. It is possible to freely control fogging by adjusting the bias potential applied to the photoconductive layer 5. In this manner, a single process is capable of forming on the recording medium 6 a positive-to-positive electrostatic latent image having excellent half-tone reproducibility and high fidelity to the original image.

The latent image thus obtained can be rendered visible through deposition of a toner thereon by the known electrophotographic developing art. The visible image is fixed either on the recording medium directly or is transferred therefrom onto another recording medium such as paper and then is fixed. Moreover, it is of course possible to transfer the latent image from the recording medium 6 onto other dielectric layer and then develop the image to render it visible.

Although in the foregoing example a positive high voltage is applied to the corona charger 15, the same result is attainable by using an n-type photoconductor and applying a negative high voltage while inverting the polarity of the other potential source.

Now a further, specific explanation will be given on each means. The base screen of control grid 1 is represented by the number of meshes or lines per inch, and a preferred value ensuring a satisfactory result is within a range approximately from 50 to 600 lines. Since the resolution of the electrostatic latent image produced by the present invention is determined by the number of these lines, it is necessary to use a fine-mesh screen in case a high-resolution image is required. Typical materials usable for the base screen (conductive base screen 3) include various metals and alloys such as stainless steel, iron, nickel, copper, brass and aluminum. The screen may be in the shape of a flat plate with holes, a woven member of metallic wires and so on. The total thickness of the control grid 1 is preferably 50 to 500 $\mu$.

As for the photoconductive layer 2, the known photoconductors used in electrophotography are mostly suitable, including selenium, selenium tellurium, selenium arsenic, cadmium sulfide, zinc oxide, and organic photoconductor such as polyvinyl carbazole. In the above-mentioned known process, a dark resistance of $10^{12}$ $\Omega$cm or so is required due to the necessity of holding electric charges on a photoconductor sufficiently for a fixed time (0.1 to several seconds). According to the present invention, however, even by the use of a photoconductor of a smaller dark resistance, it is possible to obtain a value of voltage on the control grid sufficient to control ions merely by increasing the amount of discharge of the corona discharger 15. One of the features of this invention resides in the point that an image of satisfactory contrast can be formed even on a photoconductive layer having a dark resistance of $10^9$ Ωcm or so if its photosensitivity is sufficiently high. For example, when producing a photoconductive layer of high photosensitivity on the base screen by simultaneously evaporation deposit of selenium and tellurium, as the addition of tellurium increases, the sensitivity also increases, with a concomitant decrease of the dark resistance, whereby the static charge cannot be held on the photoconductive layer for the length of time necessary for ion projection conducted subsequently to light exposure. In the present invention, a satisfactory image is obtainable even on such a photoconductive layer that has been unusable heretofore by the above-mentioned known process for the reason that a sufficiently high dark resistance is not attained though its sensitivity is high. The non-conductive layer 4 shown in FIG. 2 can be produced by the art of spraying or evaporation deposit of a general high-molecular material or inorganic nonconductive material on the base screen. The conductive layer 5 for application of bias potential can be obtained by evaporation deposit of a metal or the like. The control screen is producible in the manner described above, but it need not always be of a four-layer structure as illustrated in FIG. 2. For example, the side of the conductive layer 3 facing the aperture 10 may be covered with a photoconductive layer or a nonconductive layer.

The recording medium 6 has a double-layer structure composed of a conductive base 8 and a nonconductive layer 7 superposed thereon. The color and electrical properties of the recording medium can be improved by dispersing a dielectric substance and a pigment into a high-molecular substance and applying the mixture to form a nonconductive layer. The conductive base is composed of a metallic paper board, a conductively treated paper, or a plastic film covered with a conductive layer.

In addition to the first exemplary constitution of the present invention described hereinabove, we have also found that formation of an excellent electrostatic latent image, which is the object of the invention, is possible by the following method as well. That is, in the state where the conductive layer 5 for application of bias voltage is omitted in the control grid 1 of the structure shown in FIG. 2, the same ion control effect is achieved as in the foregoing method by charging the nonconductive layer 4 prior to the discharge performed at the time of projecting an optical image for exposure. The fog density and so forth are controllable through control of the charging potential applied to the nonconductive layer 4. In this case, an electrostatic latent image can be formed on the recording medium 6 by using a Corotron to charge the nonconductive layer 4 and controlling the voltage applied thereto, or by using a corona charge (Scorotron) equipped with a control grid and controlling the voltage applied thereto.

We have further found that employment of a transfer member is effective in forming a latent image of high contrast which is one of the object of this invention. When charging and exposure are conducted simultaneously in the latent image forming process, the light impinging on the recording medium 6, which light has passed through the apertures of control grid 1, is reflected by the recording medium and falls on the photoconductive layer 2 in the periphery of the exposed region. It is obvious that the image contrast is reduced due to such incident light. In suppressing this reduction of the contrast, a satisfactory result was obtained by using the recording medium 6 having a surface colored so as to absorb the light to which the photoconductive layer of the control grid 1 is sensitive. In general, the surface is blackened. A specific recording medium may be produced by using a nonconductive high-molecular substance as a binder, and dispersing in the binder a black pigment such as carbon black, iron black, chrome black or an organic dispersive substance dyed in black. If necessary, an additive agent such as zinc oxide or titanium dioxide used normally for a dielectric layer or electrostatic recording paper may be added into the above binder. By blackening the nonconductive layer 7 of recording medium 6 in this manner, it becomes possible to prevent the reflection of light therefrom, so that a clear copy image of remarkably high contrast can be obtained by the latent image forming method of this invention.

A satisfactory result is also attainable by the use of a recording medium having a transparent nonconductive resin layer on a black conductive base, or a recording medium having a black conductive layer on one side of a transparent non-conductive film, or a recording medium having a transparent nonconductive layer on a black intermediate layer formed on a conductive base. In any of these recording media, the light having passed through the apertures of the aforementioned screen is incident upon the transparent nonconductive layer and then is absorbed mostly by the black base or intermediate layer or conductive layer, so that the reduction of contrast resulting from the reflected light is thus prevented. It may be needless to say that, when an electrostatic latent image formed on such a black recording medium is developed with a black toner, the toner image is to be transferred onto ordinary paper or the like. Moreover, if a black recording medium composed of a paper base is used as a final image support member, some other toner than a black one is to be selected. And in the case of effecting exposure by the colored light separated by means of a filter or the like, a recording medium adapted to absorb only such light may be used.

EXAMPLE 1

A commercially available 200-mesh stainless steel screen was coated, by means of a sprayer, with a coating composition comprising 1 part of a alkyd polymer (J555; made by Dainihon Ink Company) and 5 parts of toluene by weight, so that the coated layer had a thickness of about 30 microns. Subsequently, the resin was kept at 100° C. for 30 minutes so as to be thermally hardened. Aluminum was evaporated thereon to form a thin conductive layer, and then selenium was evaporated on the reverse side to a thickness of 30 microns. The recording medium used had an aluminum layer evaporated on one side of a Mylar base of 25-micron thickness. Using the thrush prepared control grid and recording medium, an electrostatic recording process was conducted with the system shown in FIG. 3. In the disposition as illustrated in FIG. 3, a potential of +8 KV was applied to a charger 15, +2 KV to a base screen 3 of a control screen, and +2.1 KV to a bias layer 5, respectively, and while exposure was effected in the manner that the illumination intensity of the light from a projector 17 became 500 mW/m$^2$ on the surface of the photoconductive layer, the charger 15 was moved at a speed of 20 cm/sec to cover the entire image area, so that an electrostatic latent image was formed on the recording paper 6. This latent image was developed by the known technique of magnetic brush development, and a considerably satisfactory positive-to-positive image was obtained. In FIG. 3: 18 is an original, 19 is a back plate of conductive transparent glass provided on the corona charger 15 and 30 is an image projection lens.

EXAMPLE 2

A recording medium 6 was produced by coating an aluminum plate with a mixture containing an acrylic polymer and carbon black 3 percent by weight dispersed therein so that the coating had a thickness of 10 microns. An electrostatic latent image was formed on this recording medium in the same manner as that in Example 1, and after development by means of a magnetic brush, the toner image was transferred electrostatically onto ordinary paper. As the result, a clear image of high contrast was obtained.

EXAMPLE 3

A recording medium was produced by coating an aluminum plate with a black melamine paint to a thickness of several microns and, after baking, further coating it with a transparent acrylic resin to a thickness of several microns. An image was formed in the same manner as that in Example 2, and an image of fine quality was ensured.

EXAMPLE 4 (Another embodiment)

Figure 4:
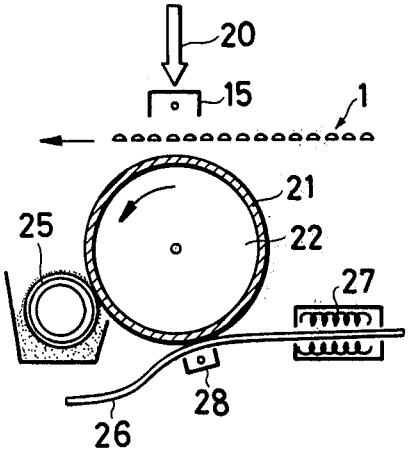
FIG. 4 is an elevational view showing one embodiment for copying process according to the present invention.

FIG. 4 illustrates an exemplary embodiment using the process of this invention. In the state where slit scanning exposure of an optical image represented by a thick arrow 20 and discharging from a charger 15 are performed simultaneously on a four-layer control grid 1 to which a bias voltage is applied, the grid 1 and a recording drum 22 covered with such a recording layer 21 as shown in FIG. 2 are driven synchronously with the image exposure in the direction indicated by the arrows in FIG. 4. A latent image obtained by the above method is developed in a magnetic brush developer 25, then the developed image is transferred onto a copy paper 26 by means of a transfer electrode 28, and further the transferred image is fixed in a fixer 27 so as to be rendered permanent. In this manner, a high-quality image with faithful gradation reproducibility was produced successfully in the process remarkably simpler than the copying process using a conventional control grid.

What is claimed is:

1. Apparatus for forming an electrostatic image on a recording medium, in which a control grid controls ion current, comprising:

a control grid having a plurality of apertures and positioned adjacent to said recording medium for controlling ion current, said control grid having a photoconductive layer, a conductive layer and an insulating layer, which are superposed in this order;

means for forming a first electric field between said control grid and said recording medium to direct ions toward said recording medium, said means being connected to said conductive layer;

means for forming a second electric field in the apertures of said control grid to prevent ions from passing through said apertures;

an electrically discharging means for projecting ions on the surface of said photoconductive layer;

an optical image projection means for forming an optical image on said surface of said photoconductive layer; and said electrically discharging means and said optical image projection means being arranged so that the area of said control grid which is being exposed to the ion current from said electrically discharging means is exposed to the light from said optical image projection means.

2. Apparatus for forming an electrostatic image on a recording medium comprising:

a control grid having a plurality of apertures and positioned adjacent to said recording medium for controlling ion current;

said control grid having a photoconductive layer, a conductive layer and an insulating layer, which are superposed in this order;

means for applying a first bias voltage to said conductive layer to form an electric field for directing ion current having passed through said apertures of said control grid toward said recording medium;

means for providing a second bias voltage higher than said first bias voltage to form a second electric field for controlling passage of the ion current through said control grid:

an electrically discharging means for projecting ions on the surface of said photoconductive layer; and an optical image projection means for forming an optical image on said surface of said photoconductive layer, said electrically discharging means and said optical image projection means being arranged so that the area of said control grid which is being exposed to the ion current from said electrically discharging means is exposed to the light from said optical image projection means.

3. Apparatus according to claim 2, wherein said control grid further comprises a second conductive layer on said insulating layer, and said means for providing said second bias voltage includes a power source connected to said second conductive layer.

4. Apparatus according to claim 2, wherein said means for providing said second bias voltage is an electrically discharging means for depositing electric charges on said insulating layer.

5. Apparatus according to claim 2, wherein said first bias voltage is 500 to 4000 volt and said second bias voltage is higher than said first bias voltage by 50 to 300 volt.

6. Apparatus according to claim 1, wherein said recording medium is colored to absorb the light thereon which has passed said control grid.

7. Apparatus according to claim 6, wherein said recording medium comprises a conductive layer and an insulating layer superposed thereon, said insulating layer of said recording medium having a binder of insulating material with pigment particles dispersed therein, which absorbs the component of said light to which said photoconductive layer is sensitive.

8. Apparatus as defined in claim 6, in which the recording medium has a transparent insulating layer on a conductive base, said base having a colored surface to absorb said incident light.

9. Apparatus as defined in claim 6, in which the recording medium has a black intermediate layer on a conductive base and further has a transparent insulating layer on said intermediate layer.

10. A method for reproducing an image, in which an electrostatic latent image is formed on a recording medium by ion current controlled by a control grid, comprising the steps of:

arranging said recording medium parallel to a control grid having a photoconductive layer, a conductive layer and an insulating layer, superposed in this order;

applying a first voltage to said conductive layer to form a first ion current-controlling electric field; providing a second voltage on said insulating layer higher than said first voltage to form a second ion current-controlling electric field;

exposing the surface of said photoconductive layer to image light; and projecting ion current toward said surface, said exposing step and said projecting step being simultaneously conducted, whereby imagewise ion current is directed to said recording medium.

11. A method according to claim 10, wherein said control grid comprises a second conductive layer on said insulating layer and said second voltage is provided by connecting said second conductive layer to an electric source.

12. A method according to claim 10, wherein said first voltage has a value of 500 to 4000 volt and said second voltage has a value of said first voltage plus 50 to 300 volt.

* * * * *